United States Patent [19]

Alt

[11] 3,955,974

[45] May 11, 1976

[54] APPARATUS AND METHOD FOR TREATING A METAL MELT WITH A VAPORIZABLE SUBSTANCE

[75] Inventor: Anton Alt, Metzkausen, Germany

[73] Assignee: Georg Fischer Aktiengesellschaft, Schaffhausen, Switzerland

[22] Filed: July 3, 1974

[21] Appl. No.: 485,702

Related U.S. Application Data

[63] Continuation of Ser. No. 253,957, May 17, 1972, abandoned, which is a continuation-in-part of Ser. No. 793,065, Jan. 22, 1969, Pat. No. 3,666,449.

[30] Foreign Application Priority Data

Aug. 11, 1973 Germany ..... 2340751
May 18, 1971 Switzerland ..... 7261/71

[52] U.S. Cl. ..... 75/130 R; 75/65 R; 75/130 B

[51] Int. Cl.[2] ..... C22C 33/08

[58] Field of Search ..... 75/130, 65, 58

[56] References Cited

UNITED STATES PATENTS

| | | | |
|---|---|---|---|
| 3,346,777 | 8/1968 | Reding | 75/130 R |
| 3,598,575 | 8/1971 | Jarysta | 75/130 R |
| 3,634,066 | 1/1972 | Matthews | 75/65 R |
| 3,666,449 | 5/1972 | Alt | 75/130 C |
| 3,802,680 | 4/1974 | Anders | 75/130 B |
| 3,833,361 | 9/1974 | Kusada | 75/130 R |

*Primary Examiner*—Peter D. Rosenberg
*Attorney, Agent, or Firm*—Toren, McGeady and Stanger

[57] ABSTRACT

A procedure is disclosed for treating a metal melt, such as an iron melt, with a vaporizable substance, such as, for example, unalloyed magnesium. The treatment is carried out in a reaction vessel within whose reaction space a wall enclosed chamber is located which communicates with the reaction space of the vessel through vertically spaced passages. The substance to be vaporized is placed into the chamber and metal melt is charged into the reaction space of the vessel. The metal melt rises along the wall of the chamber and enters the chamber to vaporize the substance. The passages which establish the communication between the chamber and the reaction space may be initially blocked by mechanical means or by a material which is dissolved or destroyed by the metal melt.

6 Claims, 5 Drawing Figures

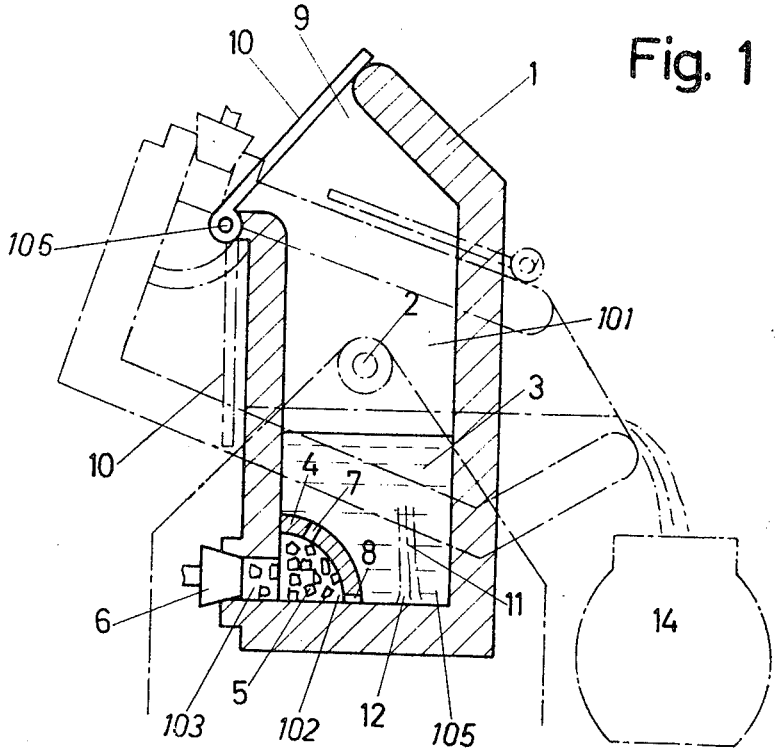
Fig. 1
Fig. 2
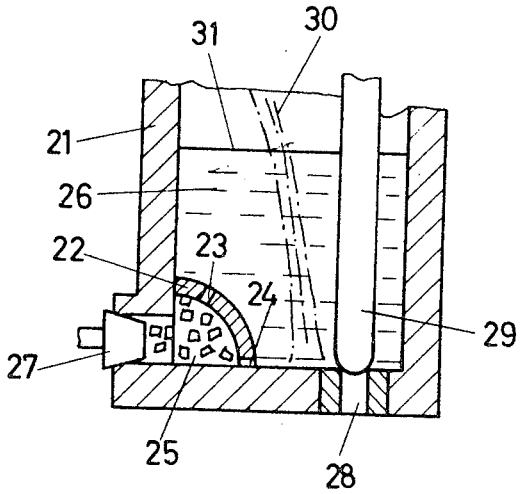
Fig. 3
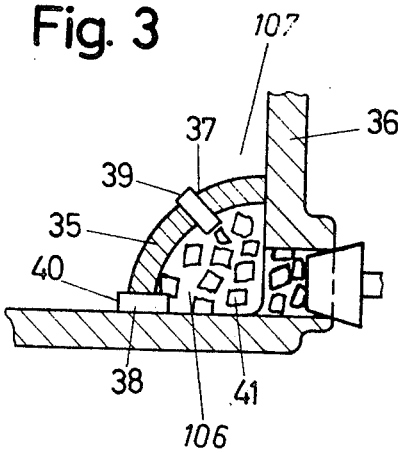

APPARATUS AND METHOD FOR TREATING A METAL MELT WITH A VAPORIZABLE SUBSTANCE

This is a continuation of application Ser. No. 253,957 filed May 17, 1972, and now abandoned, which was a continuation-in-part of my previous copending application, Ser. No. 793,065 filed Jan. 22, 1969, now U.S. Pat. No. 3,666,449.

The application discloses both a method and apparatus for the inventive treatment.

FIELD OF INVENTION

The invention relates to a procedure for treating a metal melt with vaporizable additives or substances. The invention is particularly applicable to the treatment of iron melts with unalloyed magnesium. The inventive treatment procedure is carried out in a reaction vessel containing within its reaction space a wall enclosed chamber adapted to accommodate the substance to be vaporized. The chamber communicates with the reaction space of the vessel by means of a plurality of vertically spaced passages, to wit, passages which extend at different distances from the bottom of the reaction vessel.

BACKGROUND INFORMATION

In a previously proposed procedure for vaporizing a substance by a hot melt for the purpose of treating the melt with the vaporized substance, the melt is charged into a tiltable reaction vessel and the substance to be vaporized is accommodated in a chamber which communicates with the reaction space of the vessel through openings. In order to initiate the vaporization of the substance, the reaction vessel is tilted whereby the substance to be vaporized is dipped under the surface of the melt. The speed of the vaporization is controlled by the openings of the chamber containing the substance. This procedure requires a first tilting movement of the reaction vessel for the filling of the metal melt into the vessel and a second tilting movement for moving the vessel into an upright position and thus the initiation of the vaporization of and treatment with the substance. A third tilting movement is necessary after the treatment in order to pour the treated melt into another vessel for shipping or further processing. It will be appreciated that the numerous tilting movements required by this procedure seriously limit the number of treatments which can be carried out per time unit. The output is thus very low.

According to another procedure for treating metal melts with vaporizable substances, it has been suggested to pour the melt into a ladle which can be closed by a plug. The substance to be vaporized is then dipped or immersed into the melt containing ladle. This procedure is rather cumbersome and is unsuitable, if not impossible, for the treatment of a metal melt with unalloyed magnesium. This is so because the course of the reaction can not be properly controlled.

It has also been suggested to carry out the treatment in an upright reaction vessel wherein the substance to be vaporized is initially separated from the reaction space of the vessel by a plug-like closure arrangement. The vaporization and thus the treatment are then initiated by lifting off or removing the closure arrangement. However, this prior art procedure is again unsatisfactory in that it does not render it possible satisfactorily to control the course of the treatment. This procedure is therefore not usable for the treatment with unalloyed magnesium.

According to a more recent proposal, it has been suggested to arrange a refractory intermediate wall or bottom at a predetermined distance above the bottom of the ladle or reaction vessel. According to this proposal, however, no chamber proper is provided for the vaporizable substance which has openings for the passage of the melt and for the controlled exit of the vapor bubbles of the vaporized substance, such as magnesium. This latter procedure is therefore also unsuitable for the treatment of a metal melt with unalloyed magnesium as the course of the reaction cannot satisfactorily be controlled.

SUMMARY OF THE INVENTION

It is a primary object of this invention to provide a procedure which overcomes the disadvantages of the prior art procedures referred to.

Another object of the invention is to provide a method and apparatus for the treatment of metal melts with vaporizable substances wherein the treatment can be effected in a controlled manner and in shorter periods than has hitherto been possible.

Still another object of the invention is to provide a procedure of the indicated kind which avoids multiple tilting movements and which renders possible large outputs.

It is also an object of the invention to provide a procedure of the indicated kind wherein the lining of the reaction vessel is cooled to a lesser extent than in the prior art procedures and wherein the heat loss of the melt is minimal.

Briefly and in accordance with the invention, the substance to be vaporized is placed into a chamber or reaction space which communicates with the reaction space of the reaction vessel proper through a plurality of passages which are vertically spaced from each other, to wit, which extend at different levels above the bottom of the reaction vessel. When metal melt is charged into the reaction space of the reaction vessel, the melt rises within the reaction space of the vessel and along the wall of the chamber containing the substance to be vaporized and thus enters this chamber, the melt, of course, first entering the chamber through the passage arranged closest to the bottom of the reaction vessel. In essence, therefore, the position of the reaction vessel at the time when the melt is charged into the vessel is such that the melt, while rising within the reaction space of the vessel and along the wall of the chamber containing the substance to be vaporized, flows into the chamber through the passage means which establishes the communication between the interior of the chamber and the reaction space of the vessel. The hot metal vaporizes the substance within the chamber space and the formed vapor bubbles exit through the upper passage or passages to intermingle with and treat the melt in the reaction space of the vessel.

According to one embodiment of the inventive procedure, the passages of the chamber containing the substance to be vaporized are temporarily or initially blocked during at least a portion of the charging of the metal melt into the reaction vessel and the passages are cleared for entry of portions of the melt into the chamber and exit of vapor bubbles only after at least a portion of the charging or pouring procedure has taken place. This can be accomplished by either temporarily closing the passages by mechanical means, such as a removable cover, or by blocking the passages with a material which is either dissolved or destroyed by the hot metal melt.

The invention also provides for a reaction vessel construction suitable for carrying out the inventive procedure wherein the vessel is provided with a laterally arranged channel which opens up into the lower portion of the reaction space of the vessel and discharges melt to be poured through the channel into the vessel in a manner comparable to that of a tea kettle.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there are illustrated and described the preferred embodiments of the invention.

IN THE DRAWINGS

FIG. 1 is a sectional view of a first embodiment of a reaction vessel suitable for carrying out the inventive treatment procedure, the reaction vessel being tiltable and being shown in 2 positions;

FIG. 2 is a fragmentary sectional view of a second embodiment of an inventive reaction vessel having a plug-like closure arrangement;

FIG. 3 shows a sectional view of a chamber construction for accommodating the substance or substances to be vaporized and being provided with a closure arrangement for covering or closing the openings or passages;

Figure 4:
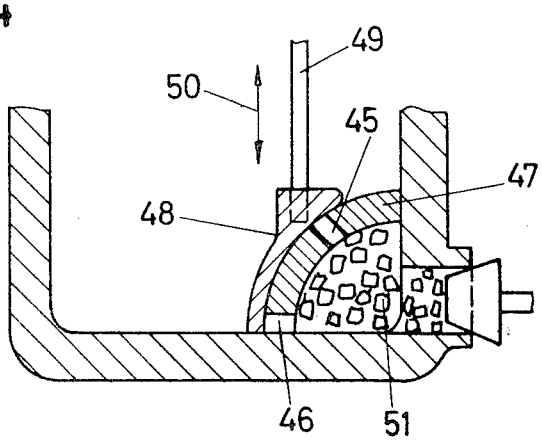
FIG. 4 shows a still further embodiment for a closure device for closing the openings or passages of the chamber accommodating the substance to be vaporized.

Referring now to the drawings, and in particular FIG. 1, reference numeral 1 indicates a reaction or treatment vessel which is tiltable about the pivot or tilting axis 2. Within the reaction space 101 of the reaction vessel 1 there is provided a separate reaction space or chamber 102 which is separated from the reaction space 101 by the wall 4. Vaporizable substance, such as for example unalloyed magnesium, is positioned within the space or chamber 102, the vaporizable substance being indicated by reference numeral 5. It will be noted that in the embodiment here shown the substance, such as the magnesium, is in solid particle form. The chamber 102 is accessible from the outside and for this purpose an opening 103 is provided which traverses the wall of the reactor 1 and which is closable by a plug 6. The chamber 102 can thus be charged with the substance to be vaporized by removing the plug 6. The wall 4 of the chamber 102 has a number of openings or passages. In the embodiment here shown two passages 7 and 8 are indicated. It will be noted that the passages 7 and 8 are vertically spaced from each other, to wit, they extend at different distances or levels from the bottom 105 of the reaction vessel 1. The reaction vessel 1 has a top opening 9 which may be closed by a hinged cover 10, the hinge or pivot arrangement being indicated at 106. In the open position of the cover 10 and while the reaction vessel 1 is in the upright position as shown in full lines in FIG. 1, melt is poured into the reaction space 101. When the melt is poured, the jet of melt 11 first strikes the bottom 105 of the reactor 1 at the area indicated by reference numeral 12, to wit, an area adjacent the chamber space 102. In order to prevent premature wear of the area 12 of the bottom 105, it is advantageous to reinforce the lining of the reactor 1 at this area by a special layer of wear resistant material. In this manner damage which otherwise may be caused by the jet of melt is successfully prevented. The melt, indicated by reference numeral 3, thus starts rising within the reaction space 101 and during its rise first enters the chamber space 102 through the passage or opening 8. That portion of the melt 3 which flows through the opening 8 thus contacts the solid substance 5 and causes its heating and vaporization. In the meantime the level of the rising melt 3 will have reached the level of the opening 7 of the wall 4 so that the vapor bubbles exiting through opening 7 initiate the treatment of the melt 3 within the reaction space 101. Of course, there will be an interplay between melt 3 which enters the space 102 and vapor bubbles which exit from the space 102 into the space 101 through the passages 7 and 8. In this manner the vapor bubbles will cause a whirling or circulating movement of the melt 3 so that the entire melt is substantially homogeneously treated by the vaporized substance.

By suitably dimensioning the passages 7 and 8, the course of the treatment or reaction can be controlled in a satisfactory manner. In this manner the inventive procedure is particularly suitable for the treatment of metal melts with unalloyed magnesium. However, it should be appreciated that other substances may be vaporized in accordance with the inventive procedure. If desired, the chamber space 102 may also contain a material which delays the treatment reaction. Thus, for example, iron alloy shavings may be positioned within the chamber space 102.

It should also be appreciated that a larger number of openings or passages may be provided instead of the two openings 7 and 8 as indicated in FIG. 1.

After the treatment of the melt 3 has been terminated, the vessel 1 is tilted into the position shown in the dash-dotted lines. By tilting the vessel 1 the treated melt is discharged, for example into a transport receptacle or a pouring ladle 14 as indicated in FIG. 1. After the reaction vessel 1 has been emptied, it is again tilted into the upright position shown in FIG. 1, to wit, the position in which the treatment of melt takes place and a fresh amount of melt can be poured through the opening 9. The replenishing of the chamber space 102 with a fresh supply of substance to be vaporized is accomplished by removing the plug 6 and reinsertion thereof after the substance has been supplied. Advantageously, the replenishing of the chamber space 102 is accomplished while the reaction vessel 1 is in the tilted position, to wit, before it is tilted back into the upright position.

FIG. 2 shows a second embodiment of a treatment vessel or reactor 21 which is generally of similar construction as the reactor 1 of FIG. 1. The chamber wall is indicated by reference numeral 22, the wall being traversed by openings or passages 23 and 24. The substance to be vaporized is indicated by reference numeral 25 while the melt bears numeral 26. The chamber space is accessible from the outside by removal of the plug 27. In contrast to the vessel of FIG. 1, the reactor 21 of FIG. 2 has an exit or discharge opening 28 which is closable by a plug member 29. After the filling of the chamber with the substance 25 and closing of the chamber with the plug 27, the melt 26 to be treated is poured in the form of the jet 30 while the exit opening 28 is closed by the plug member 29. The pouring of the melt is carried out until the melt has reached the level indicated by reference numeral 31. If the substance to be vaporized is magnesium, the reaction between the magnesium and the contacting melt starts normally during the filling procedure of the melt and has generally been terminated when the melt has reached its final level within the reactor. By removing the plug member 29 the treated melt 26 is then discharged through the opening 28 into a suitable receptacle (not shown), to wit, a pouring ladle, a casting mold, a transport vessel or the like.

The course of the treatment of a metal melt with vaporizable additives or substances can be advantageously influenced by initially blocking or closing the passages of the substance containing chamber during the filling of the metal melt into the reactor and by clearing or opening the passages only after a portion of the filling or charging procedure for the melt has taken place. Such a procedure can be accomplished in different ways, one of which is shown in FIG. 3. In FIG. 3 the chamber space 106 is separated from the reaction space 107 of the reactor 36 by means of the wall 35 which is traversed by the passages 37 and 38. The passages 37 and 38 can be closed or blocked by plugs 39 and 40. The plugs 39 and 40 may be made from a material which is dissolved or destroyed by contact with the hot metal melt. Thus, for example, in the embodiment of FIG. 3 the plugs 39 and 40 are made of a metal which is melted or dissolved by contact with the hot metal melt. This, of course, means that the treatment of metal melt poured into the reactor space 107 will only be initiated after the plugs 39 and 40 have been completely dissolved so as to clear the openings 37 and 38. Once the openings 37 and 38 have been cleared, the melt enters in the manner previously described the reaction space 106 through the opening 38 and causes the vaporization of the solid substance 41. The vapor bubbles of the vaporized substance then exit through the opening 37 and enter the melt in the reaction space 107 thereby causing a circulartory whirling movement and treatment of the melt.

FIG. 4 shows an embodiment in which the openings 45 and 46 which traverse the wall 47 of the chamber are temporarily covered or blocked by a cover member 48. Thus during the pouring or filling of the metal melt into the reactor, the cover member 48 is placed into the position shown in FIG. 4 in which the cover member blocks entry into the passages 45 and 46. The cover member 48 is advantageously made of a refractory fire resistant material, for example, it may be made of ceramic material. An actuating rod 49 is connected to the cover member 48. The cover member 48 can be removed into a position clearing the openings 45 and 46 by upward movement which is caused by lifting the rod 49. The movement directions of the rod 49 are indicated by arrow 50. Thus, the rod 49 may be lifted to remove the cover member 48 from the wall 47 or it may be lowered again for contact with the wall 47 thereby to close the passages 45 and 46. In this manner it is rendered possible to prevent contact between the poured melt and the substance 51 to be vaporized until a time when such contact is desired, to wit, for a period at which the temperature of the melt has not dropped to a value below that required for the desired treatment.

It will be appreciated that it is also feasible to cover the wall of the chamber or the passages with a layer of another material, such as for example a plastic material, which material is then destroyed by the hot melt in contact therewith.

Figure 5:
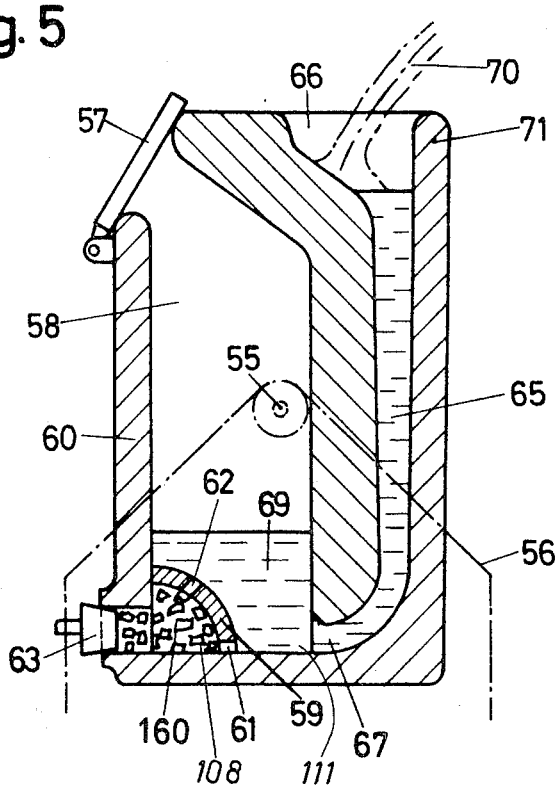
FIG. 5 is another embodiment of a reaction or treatment vessel having a lateral channel for the charging and discharging of the metal melt.

Turning now to FIG. 5 it will be noted that the reaction vessel 60 is tiltable about a pivot or tilting axis 55 within the frame structure diagrammatically indicated by reference numeral 56. As in the preceding embodiments, a chamber 108 is provided within the reaction space 58 of the reactor 60, the chamber 108 being separated from the reaction space 58 by the wall 59. The wall 59 is traversed by the passages 62 and 61. As in the preceding embodiments, the chamber structure 108, 59 is arranged adjacent the bottom 111 of the reactor 60, and the chamber space 108 is accessible from the outside by removal of the plug 63. The substance to be vaporized is in solid form and is indicated by reference numeral 160. The passages 61 and 62 are vertically spaced from each other, to wit, they are arranged at different levels above the bottom 111.

Laterally adjacent the reaction space 58, the reactor 60 is provided with a channel 65 which in the operative position of the reactor, to wit, the position in which the melt is to be treated, extends substantially in vertical direction. The channel 65 widens in the upper portion to form a funnel-like configuration indicated by reference numeral 66. The lower portion of the channel 65 opens into the reactor space 58 above the bottom 111. The transition zone in which the channel 65 merges into the reaction space 58 is indicated by reference numeral 67. It will be noted that the channel 65 extends on that side of the reactor which is opposite to that of the chamber 108, 59.

The pouring characteristics of the channel 65 are similar to those of a tea kettle. The channel 65 is used not only for discharging treated metal melt from the reactor but also for charging the untreated melt 69 into the reactor. Thus, in the upright position of the reactor 60, metal melt is poured or charged through the funnel portion 66 as indicated by the jet 70. The poured metal thus flows through the channel 65 and through the transition zone into the reaction space 58. After treatment of the melt by the vaporized substance 160, the vessel 60 is tilted and the treated melt is thus discharged through the channel 65 and flows along the lip 71 into a suitable receptacle.

The provision of the laterally arranged charging and discharging channel 65 results in a number of important advantages. Thus, the charging of the melt into the reactor is accomplished uniformly and without any undesired turbulence. Further, the metal jet is not divided into drops. This in turn means that a lesser amount of oxygen will be absorbed by the melt and the cooling of the incoming melt is significantly less than in prior art procedures. The turbulence which might occur in the melt 69 which rises within the reaction space 58 is also much less pronounced than in procedures in which the melt is charged directly into the reaction space. This in turn results in the advantage that slag can satisfactorily collect at the surface. Further, the circulatory movement of the melt which is caused by the vaporization of the substance, such as magnesium, is facilitated and supported by the flow movement resulting from the charging of the melt through the channel 65. Another advantage is that the lid or cover 57 of the reactor 60 may normally be maintained in closed position during several treatment cycles, to wit, charging - treatment reaction - discharge. In this manner heat loss of the melt is significantly reduced.

From the above explanation and specific embodiments, it will be appreciated that the inventive procedure for treating a metal melt with a vaporizable substance is carried out in such a manner that the position of the reaction vessel into which the melt is charged is such that the melt which rises in the vessel contacts the wall of the chamber containing the substance to be vaporized almost from the very beginning of the pouring procedure. It has been ascertained that surprisingly and in spite of the passages which traverse the chamber wall, the reaction between the melt and the substance to be vaporized does not set in immediately but only after the rising melt has reached a certain level. It can be assumed that the melt first solidifies in the region of the chamber wall and that the additives or substances contained in the chamber have first to be heated by the melt before the reaction can start. In addition to the measures disclosed in conjunction with FIGS. 3 and 4, to wit, blocking or covering of the passages between reaction space and chamber, the actual time at which the reaction starts can also be influenced by a suitable choice of the charging speed of the melt into the reaction vessel or the time necessary for accomplishing the charging. Further, by directing the jet of the poured melt in a desired manner, to wit, by choosing the area of impact for the leading portion of the jet in the reaction vessel, or by tilting the reaction vessel in a desired direction, a certain influence on the start of the reaction can be successfully exerted.

Generally, the following advantages are accomplished by the inventive method and apparatus:

By avoiding the tilting movement for the charging of the metal melt, the time for the treatment of a batch is significantly reduced so that per time unit a larger number of treatments can be carried out than has hitherto been possible. The larger throughput resulting therefrom causes in turn a lesser cooling of the reaction vessel between the individual treatments. This in turn results in a longer life of the lining since the temperature fluctuations are thus significantly reduced. The lesser cooling of the lining of the reactor causes lesser heat losses of the melt during the filling of the melt into the reactor. This advantage in turn makes it possible to use higher pouring temperatures at the same tapping temperature. In this manner the surfaces of the castings will be substantially free of slag and bubbles. A lesser charging temperature of the melt on the other hand makes it possible to reduce the temperature of the melt in cupola or induction furnaces.

What is claimed is:

1. A method for treating a metal melt with a vaporizable substance comprising the steps of:

providing a reaction vessel having a bottom and upstanding wall means extending generally perpendicularly from said bottom to define therewith a reaction space above said bottom within said vessel;

providing within said reaction space proximate said bottom an enclosed chamber at least including a wall extending with a directional component upwardly from said bottom;

providing a plurality of spaced passages extending through said chamber wall for communicating said reaction space with said chamber, said passages being provided at different vertical levels and spaced apart in a direction extending from said bottom along the direction of said upstanding wall means;

placing the substance to be vaporized within said chamber;

charging said reaction vessel with said metal melt by flowing said metal melt into said reaction space to cause said metal melt to rise from said bottom upwardly along said upstanding wall means as said metal melt is flowed into said reaction space;

maintaining said reaction vessel during said charging in a position to cause said metal melt to contact said chamber wall and progressively rise along said wall in contact therewith upwardly along the direction of said upstanding wall means thereby to cause said metal melt to progressively rise to the individual level of each of said spaced passages; and permitting portions of said metal melt to flow into said reaction chamber by permitting said metal melt to flow individually through said spaced passages to contact and vaporize said vaporizable substance within said enclosed chamber as said charging of said reaction vessel proceeds.

2. A method as claimed in claim 1, wherein said substance is unalloyed magnesium while said metal melt is an iron melt.

3. A method as claimed in claim 1, which comprises blocking said passages during at least a portion of the time during which said metal melt is charged into said reaction vessel and thereafter removing said blockage to permit portions of said metal melt to flow into said chamber.

4. A method as claimed in claim 3, wherein said passages are blocked by a material which is dissolved or destroyed by contact with said metal melt.

5. A method as claimed in claim 3, wherein said passages are blocked by mechanical means.

6. A method as claimed in claim 1, wherein the start of the reaction between said metal melt and said substance is controlled by controlling the time during which the metal melt is charged into said reaction vessel and/or the direction along which the metal melt is charged into said reaction space.

* * * * *